US007834995B2

(12) United States Patent
Scatizzi

(10) Patent No.: US 7,834,995 B2
(45) Date of Patent: Nov. 16, 2010

(54) DEVICE AND METHOD FOR CARRYING OUT OPTICAL READINGS ON TEXTILE MATERIALS SUBMITTED TO DYEING

(75) Inventor: Mario Scatizzi, Pistoia (IT)

(73) Assignee: Tecnorama S.R.L., Prato (IT)

( * ) Notice: Subject to any disclaimer, the term of this patent is extended or adjusted under 35 U.S.C. 154(b) by 413 days.

(21) Appl. No.: 12/091,974

(22) PCT Filed: Mar. 8, 2007

(86) PCT No.: PCT/IT2007/000171

§ 371 (c)(1),
(2), (4) Date: Apr. 29, 2008

(87) PCT Pub. No.: WO2008/023396

PCT Pub. Date: Feb. 28, 2008

(65) Prior Publication Data

US 2008/0289125 A1 Nov. 27, 2008

(30) Foreign Application Priority Data

Aug. 24, 2006 (IT) ..... F12006A0211

(51) Int. Cl.
*G01N 21/00* (2006.01)

(52) U.S. Cl. ..... 356/238.1; 356/239.7

(58) Field of Classification Search ..... 356/238.1, 356/239.7, 237.2, 243.1–243.8; 250/576, 250/574, 573; 68/13, 185–187, 12.07; 8/636
See application file for complete search history.

(56) References Cited

U.S. PATENT DOCUMENTS 3,728,877 A 4/1973 Ondarza (Continued)

FOREIGN PATENT DOCUMENTS

EP 0 325 529 7/1989

(Continued)

OTHER PUBLICATIONS

Kazmi, S.Z. et al.: "On-Line Color Monitoring in Continuous Textile Dyeing", May 1996, ISA Transactions Instrument Society of America, Pittsburgh, U.S., pp. 33-43, XP004020078 ISSN: 0019-0578.

(Continued)

*Primary Examiner*—Gregory J Toatley
*Assistant Examiner*—Tri T Ton
(74) *Attorney, Agent, or Firm*—McGlew and Tuttle, P.C.

(57) ABSTRACT

Device for carrying out optical readings on textile materials submitted to dyeing comprising optical reading means associated with corresponding optical processing means, characterised in that it comprises a body (1) inside which it is provided a chamber (10) featuring an input (I) and output (U) section and is crossed by a dyeing bath drawn out of a dyeing tank or machine (T) in which a textile material is submitted to dyeing, inside said chamber (10) being disposed an optical detector or probe (2) and a seat being provided for the positioning of a specimen or sample (F) of the textile material submitted to dyeing in correspondence of the probe (2), said seat featuring positioning means for a support (3) onto which said specimen (F) is applied, so that the specimen is immersed in the dyeing bath flowing inside chamber (10), said support (3) being movably positioned on said positioning means; and said support (3) is movable towards said probe (2) or, vice versa, said probe (2) is movable towards said support (3).

16 Claims, 14 Drawing Sheets

U.S. PATENT DOCUMENTS 3,986,778 A 10/1976 Mathisen et al.

FOREIGN PATENT DOCUMENTS

| | | |
|---|---|---|
| EP | 0 777 007 A1 | 6/1997 |
| FR | 2 307 074 | 11/1976 |
| FR | 2 399 066 | 2/1979 |
| FR | 2 443 524 | 7/1980 |
| GB | 2 050 002 | 12/1980 |
| JP | 1006164 | 1/1989 |
| JP | 5098557 | 4/1993 |
| WO | WO 99/66117 | 12/1999 |

OTHER PUBLICATIONS

"Analyse Von Faerbeverfahren" Melliand Textilberichte, International Textile Reports, Melliand Textilberichte, Frankfurt Am Main, DE, vol. 85, No. 1/2, Feb. 2004, pp. 64-65, XP001047241 ISSN: 0341-0781.

DEVICE AND METHOD FOR CARRYING OUT OPTICAL READINGS ON TEXTILE MATERIALS SUBMITTED TO DYEING

The present invention relates to an apparatus and a method for carrying out optical readings on textile materials submitted to dyeing.

More particularly, the device and method of the present invention relate to the control of depletion, that is to say of the absorption, of single colouring agents in a dyeing bath.

Optical systems and processes based on transmittance spectrophotometry are well-known in this field. By means of these systems, the concentrations of the single colouring agents present in the solution, that is to say in the dyeing bath, are measured by emitting a light beam having known properties through the solution. Part of the emitted light is absorbed by the substances present in the fluid, whereas the remaining part is transmitted to the spectrophotometer which detects its amount and its properties. This information is used to determine the residual quantities of the single colouring agents present in the solution according to the well-known Beer-Lambert law.

It is also known that, whatever the specific algorithm used to process the above information, the exact determination of the residual quantities of the single colouring agents present in a dying bath is still an unsolved problem from a practical viewpoint, considering the innumerable chemical and dyeing types of the various colouring agents used in textile industry.

The use of known optical systems for transmittance readings leads to practical difficulties in determining the concentration of the single colouring agents present in a dyeing bath with sufficient exactness, especially when concentrations are very small or higher than a given value. In practice, the known optical systems are ineffective in the control of solutions containing colouring agents whose concentrations are external to a given range. In other words, the optical control systems currently available on the market are basically unusable for practical purposes when the concentrations concerned assume values which are not within a given range, that is to say when solutions are too diluted or too concentrated.

Further inconveniences caused by the use of known optical systems are due to the remarkable lack of precision in the results obtained by carrying out readings on solutions containing heterogeneous colouring agents, that is of different chemical classes. Inconveniences also derive from a substantial inability of these known systems in distinguishing two different colours of the same kind (two reds, two yellows or two blues present in the same solution).

Other inconveniences are caused by the state changes, that is by the colour changes of the single colouring agents when the pH, the salinity or the temperature of the solution vary, as normally happens during the dyeing cycle: in fact, in this case the transmittance optical control does not guarantee correct and homogeneous readings, since chromatic changes may occur or the dyeing bath may become torpid.

Moreover, the control carried out on dispersions and on opalescent baths are very difficult as the light transmission through the liquid is altered, because part of the light is deviated by the dispersed particles within the liquid. This leads to erroneous evaluations, that is, the spectrophotometer evaluations can be wrong.

Examples of apparatuses for carrying out controls by transmittance readings on dyeing baths are described in EP 325529, FR 2399066, FR 2307074, FR 2443524, GB 2050002, JP 1006164, WO 99/66117, JP 5098557 and JP 61105432.

The main object of the present invention is to eliminate or at least drastically reduce said drawbacks.

According to the present invention, these results have been achieved thanks to the device and the method having the features described in the independent claims. Further features of the present invention are the subject of the dependent claims.

Thanks to the present invention, it is possible to carry out a depletion test of the single colours (red, yellow, blue) in a dyeing bath whatever the class or nature of the colouring agents used, even in case of very low or of high concentrations, and even in case of opalescent baths or in the presence of dispersed particles. In particular, thanks to the present invention, it is possible to use the detections carried out by two different devices for testing the absorption of single colours with different modalities, in order to basically eliminate the possibility of reading mistakes; in particular, depending on the bath temperature, it is possible to use the most suitable device for carrying out a detection as properly and as much precisely as possible. Moreover, the present apparatus and method allow said testing directly on the material of the specimen or sample or "witness" immersed in the dyeing bath, so that the results obtained with the test take into account the specific nature of the material submitted to dyeing. A further advantage is the possibility of carrying out repetitive readings with sufficiently high frequency so that they can be considered as "dynamic readings", or, in other words, continuous readings. Moreover, an apparatus according to the present invention is easy to be made, economical and reliable, even after long operating periods.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1:
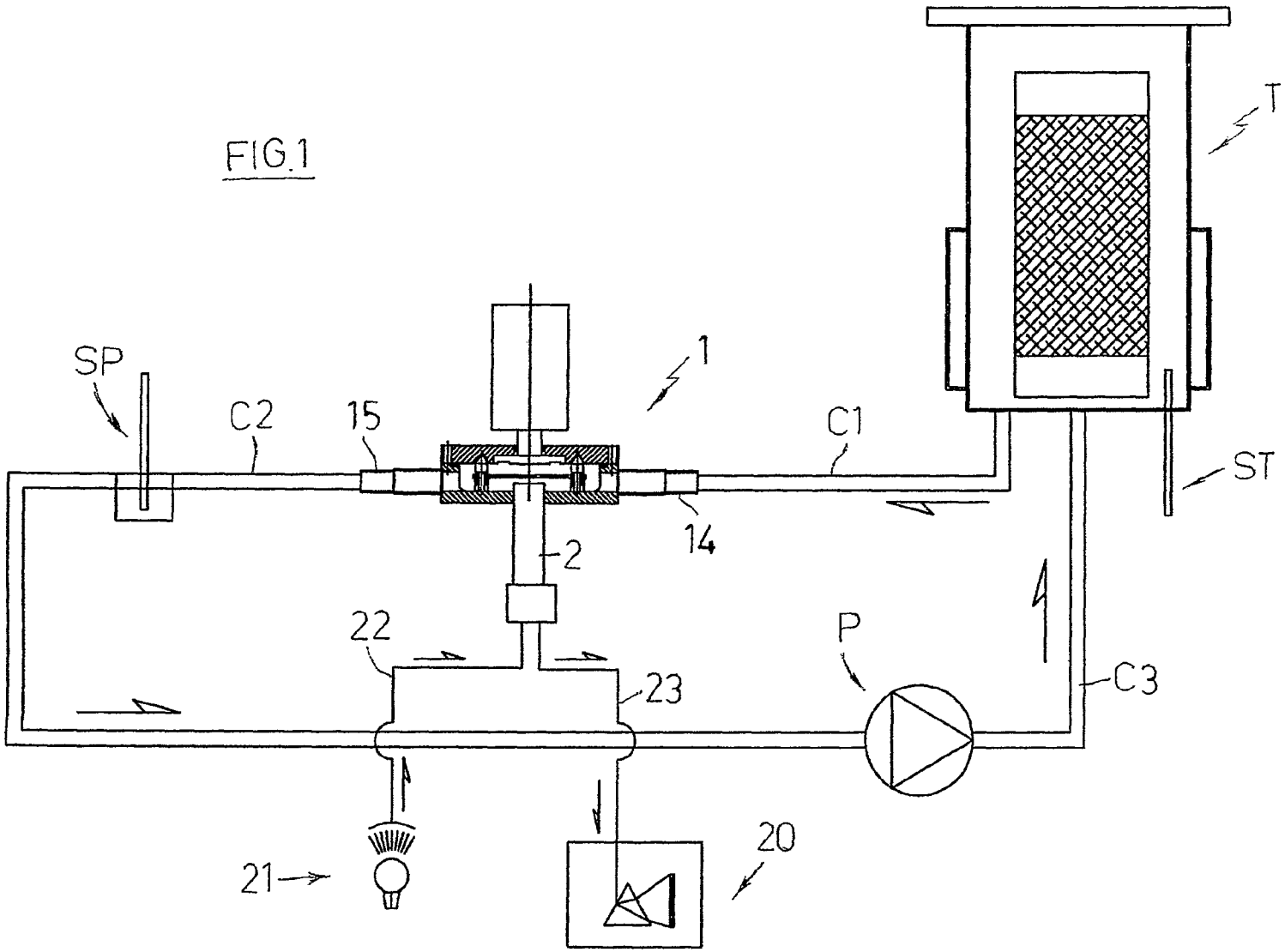
FIG. 1 represent a possible scheme illustrating the use of a device (1) according to the present invention.

Reduced to its basic structure and with reference to FIGS. 1-14 of the enclosed drawings, a device (1) according to the present invention comprises a chamber (10), delimited by a fixed lower base (11) having corresponding fixed side walls (12), and by a mobile upper base (13). An input section (I) and an output section (U) associated with corresponding pipe unions (14, 15) are provided on two opposite side walls of fixed base (11) to allow the mounting thereof in a circuit of the type shown in FIG. 1, as further described below.

Said fixed base (11) features a central opening in which it is inserted an optical detector or probe (2), the latter being connected to a spectrophotometer or calorimeter (20) as described below.

Probe (2) can consist of any optical detector or sensor available on the market which can be connected to a spectrophotometer or calorimeter.

Four fixed columns (16) are mounted on the internal bottom of said fixed base (11) and a fixed conical tip (17) is mounted on each of said columns. A bushing (18) is provided on each column (16) between the bottom of fixed base (11) and the corresponding tip (17). The bushing is provided with an annular projection or ring whose lower side (18L) is mounted on the upper base of a spring (19). The lower base of said spring (19) is placed on the internal bottom of fixed base (11).

Said columns (16) are orthogonally oriented towards the bottom of fixed base (11) which is preferably in a horizontal position when the device is used. As a consequence, bushings (18) are orthogonal to the bottom of base (11).

Due to the presence of springs (19), each bushing (18) can be pushed down towards base (11) and, once exhausted the thrust which overcomes the resistance of the respective spring (19), it can return to its lifted starting position. This allows a correct circulation of the dyeing bath inside chamber (10) and a consequent more uniform dyeing of the specimen or sample as mentioned below.

Moreover, device (1) comprises a support element for a specimen or sample of the textile material submitted to dyeing.

According to the example shown in the accompanying drawings, said support element comprises a plate (3) provided with a circular central opening or window (30) and also provided with four passing holes (31) which are disposed according to the vertices of a quadrangle. With reference to the example shown in FIGS. 2 and 3, said holes (31) are provided on four corresponding appendixes (32) of plate (3).

Said holes (31) allow the positioning of plate (3) on upper sides (18U) of the rings provided on the external surface of said bushings (18).

In practice, said bushings (18) constitute elastic positioning and support elements for plate (3) and allow its guided lowering towards the internal bottom of fixed base (11) and respectively its guided lifting.

Figure 3:
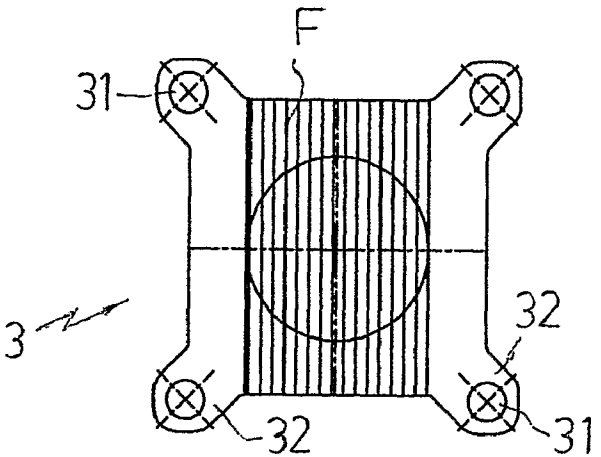
FIG. 3 shows a schematic plan view of the support of FIG. 2, on which a specimen or sample of textile material is placed.
Figure 2:
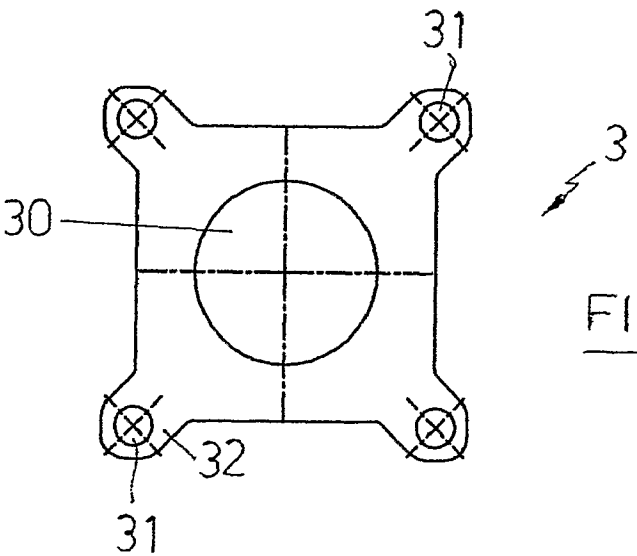
FIG. 2 shows a schematic plan view of the support for the specimen or samples of the textile materials submitted to dyeing.
Figure 4:
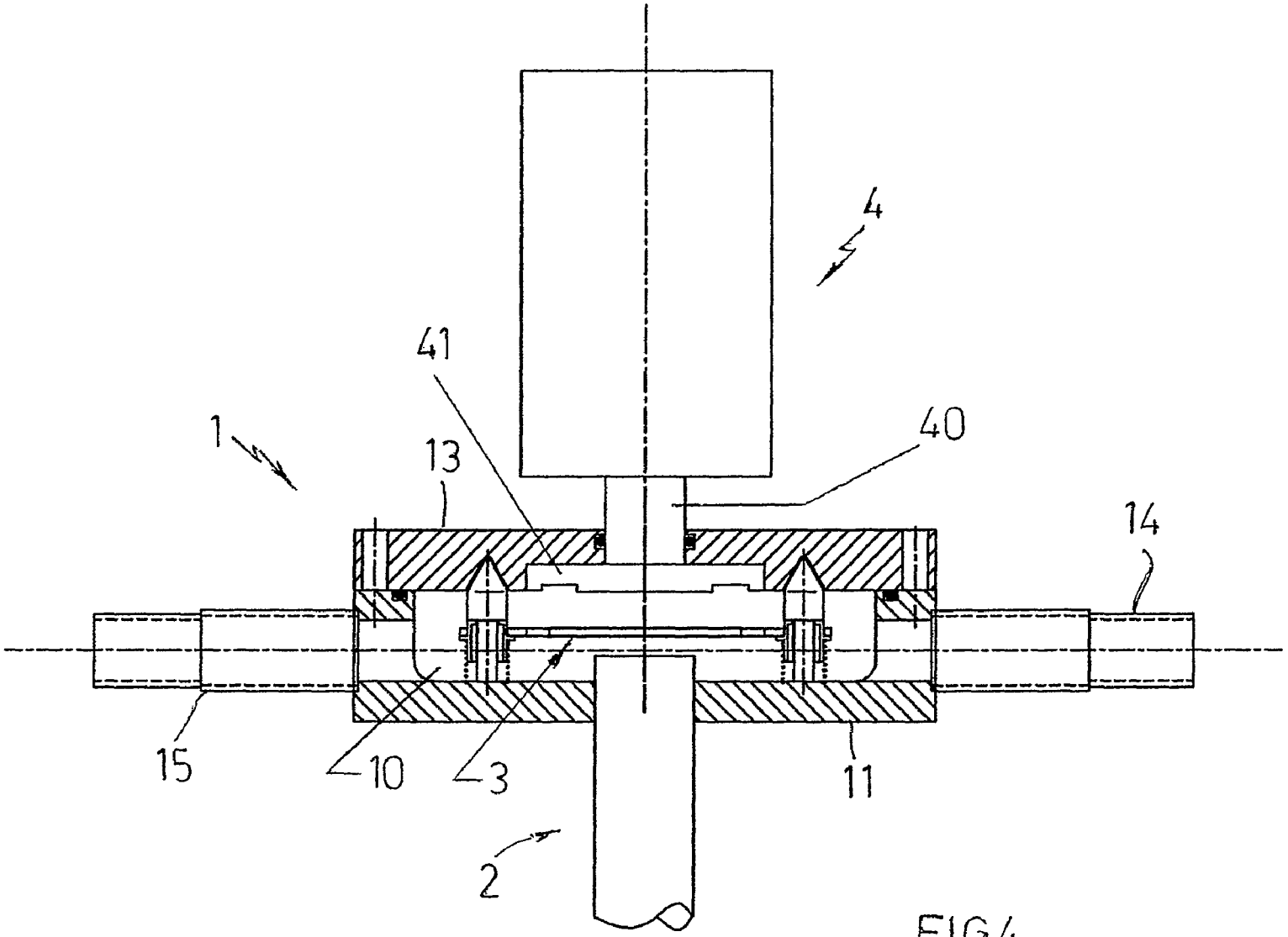
FIG. 4 shows a schematic longitudinal section view of a device according to the invention.
Figure 6:
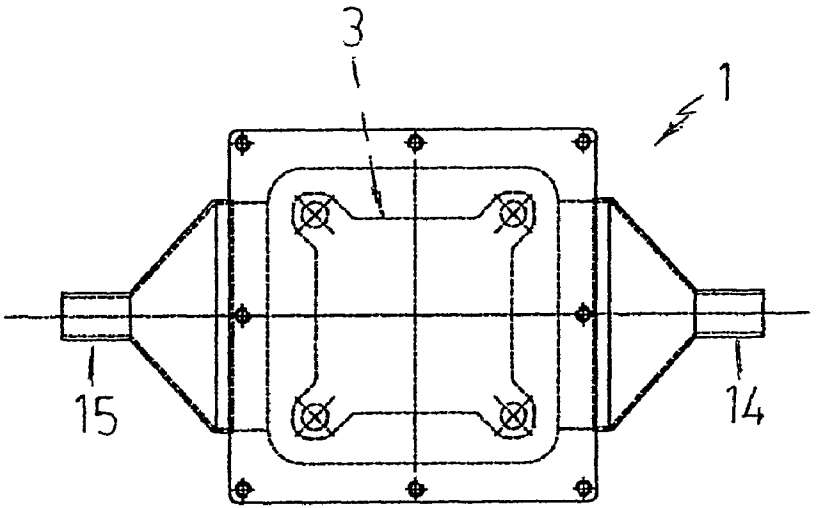
FIG. 6 shows a top plan view of the device shown in FIG. 4.
Figure 5:
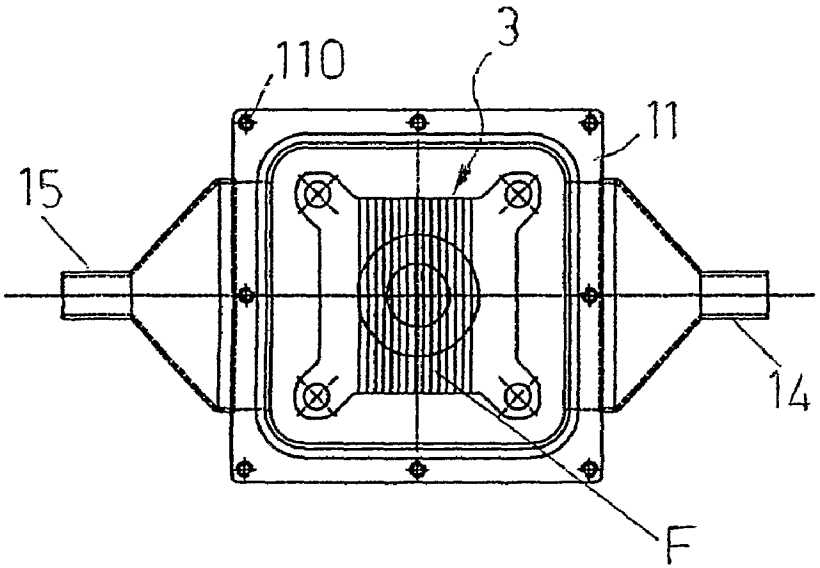
FIG. 5 shows a top plan view of the specimen chamber of the device shown in FIG. 4, with the support of FIG. 3 inserted in it.

The shape of said plate (3) allows a specimen or sample of the textile material submitted to dyeing to be applied on the plate itself. For example, as illustrated in FIG. 3, the specimen or sample or "witness" can consist of a given amount of threads (F) wound on plate (3) so as to cover its central window (30). The specimen can also have a different shape, i.e. it may not be in the form of threads; for example, the specimen can consist of fabric. In any case, the specimen is made of the same material submitted to dyeing and it is applied on support plate (3) so as to be adjacent to window (30).

The upper edge of walls (12) which laterally delimit said chamber (10) provides a seat for an annular gasket (G).

Upper base (13) of chamber (10) features a central opening which allows the stem (40) of an actuator (4), whose axis is oriented perpendicularly to base (13) itself, to pass through it. A pad (41) is fixed on the free end, that is to say on the lower end of said stem (40); said pad features a circular and central projecting portion (42). The diameter of said portion (42) is inferior to the diameter of the central opening (30) featured by said plate (3).

The skirt of said actuator (4) is fixed on the upper side of upper base (13) by means of a bracket (which is not shown in the drawings).

Moreover, the lower side of said upper base (13) features four cavities (130), each cavity having the shape and size corresponding to those of the upper ends of said tips (17).

Said upper base (13) features a series of passing holes (131) for screw means (not shown) which allow its connection to fixed base (11), being said base provided with corresponding holes (110). In this way, it is possible to obtain a hermetic closing of said chamber (10) which, however, features input (I) and output (U) sections for the dyeing bath.

The scheme of FIG. 1 shows:

- a first duct (C1) which, on one side, is connected to a dyeing tank or dyeing machine (T) and, on the other side, to the exit (14) of device (1);
- a second duct (C2) which, on one side, is connected to exit (15) of device (1) and, on the other side, to the entry of a pump (P) which re-conveys the bath into tank or machine (T) by means of a third duct (C3).

A pH detecting probe (SP) is inserted on the second duct (C2) whereas the bath temperature is detected by a thermometer associated with tank or machine (T).

The same scheme shows the above optical probe (2) which is connected to a lighter (21) and to the spectrophotometer or calorimeter (20) by means of corresponding optical fibres, i.e. optical cables, (22, 23).

The tank or dyeing machine (T) as well as probes (ST) and (SP), pump (P), probe (2) and lighter (21), spectrophotometer or calorimeter (20) and optical fibres (22, 23) are per se known.

The device (1) works as follows.

Figure 8:
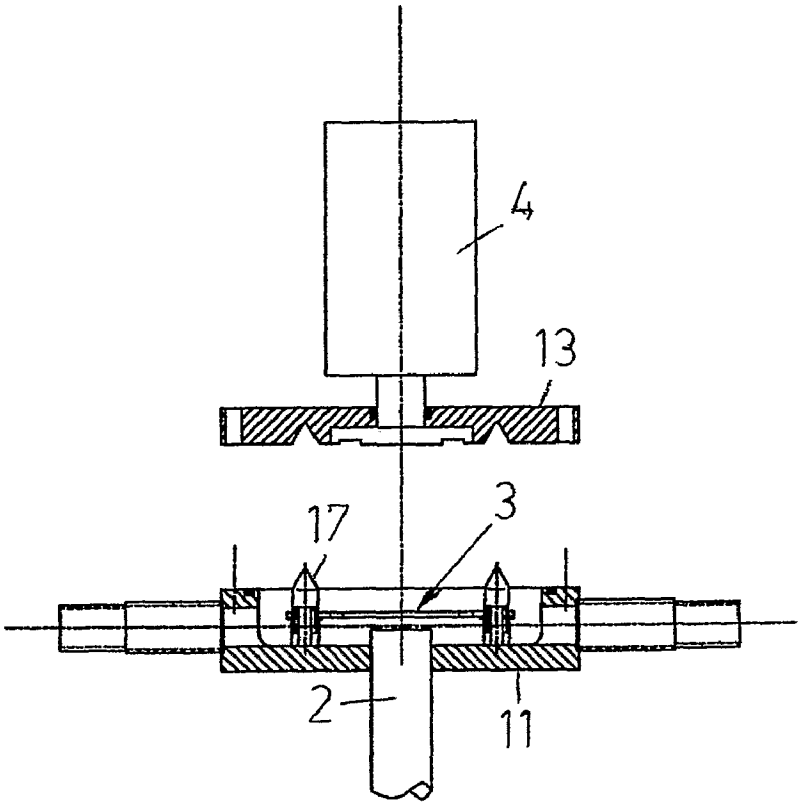
FIGS. 7-10 show a sequence of operating steps related with the use of the device shown in FIG. 4.
Figure 7:
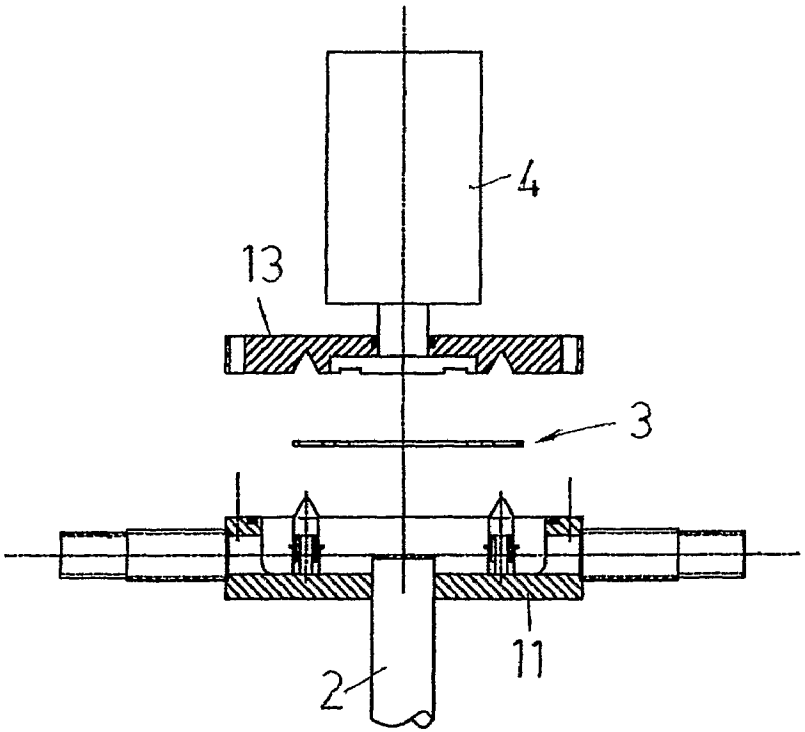
Figure 10:
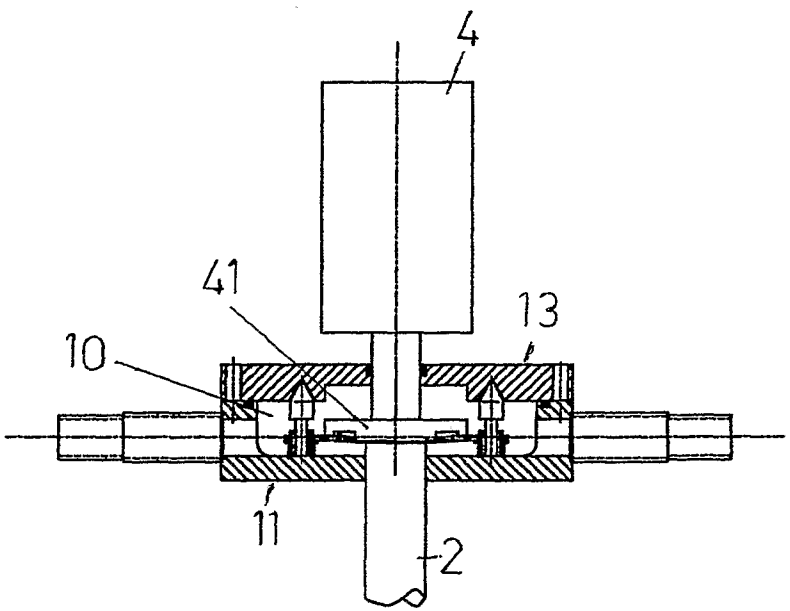
Figure 9:
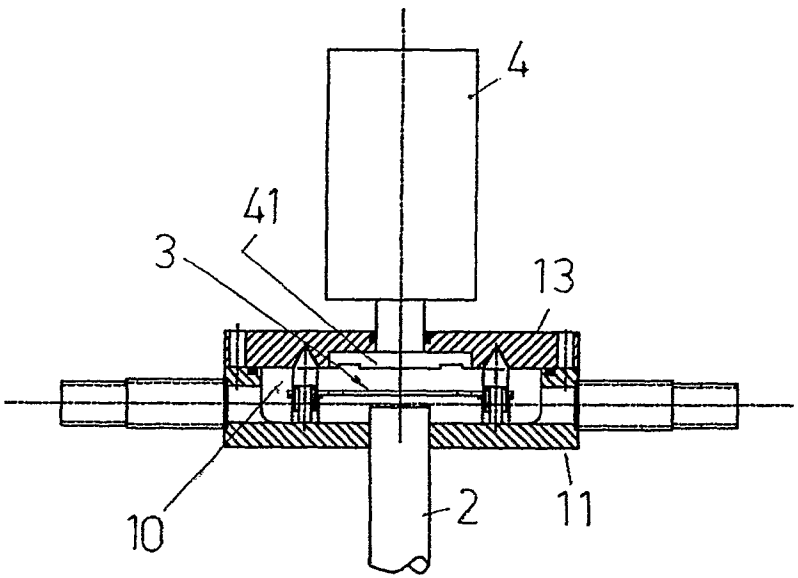
Figure 11:
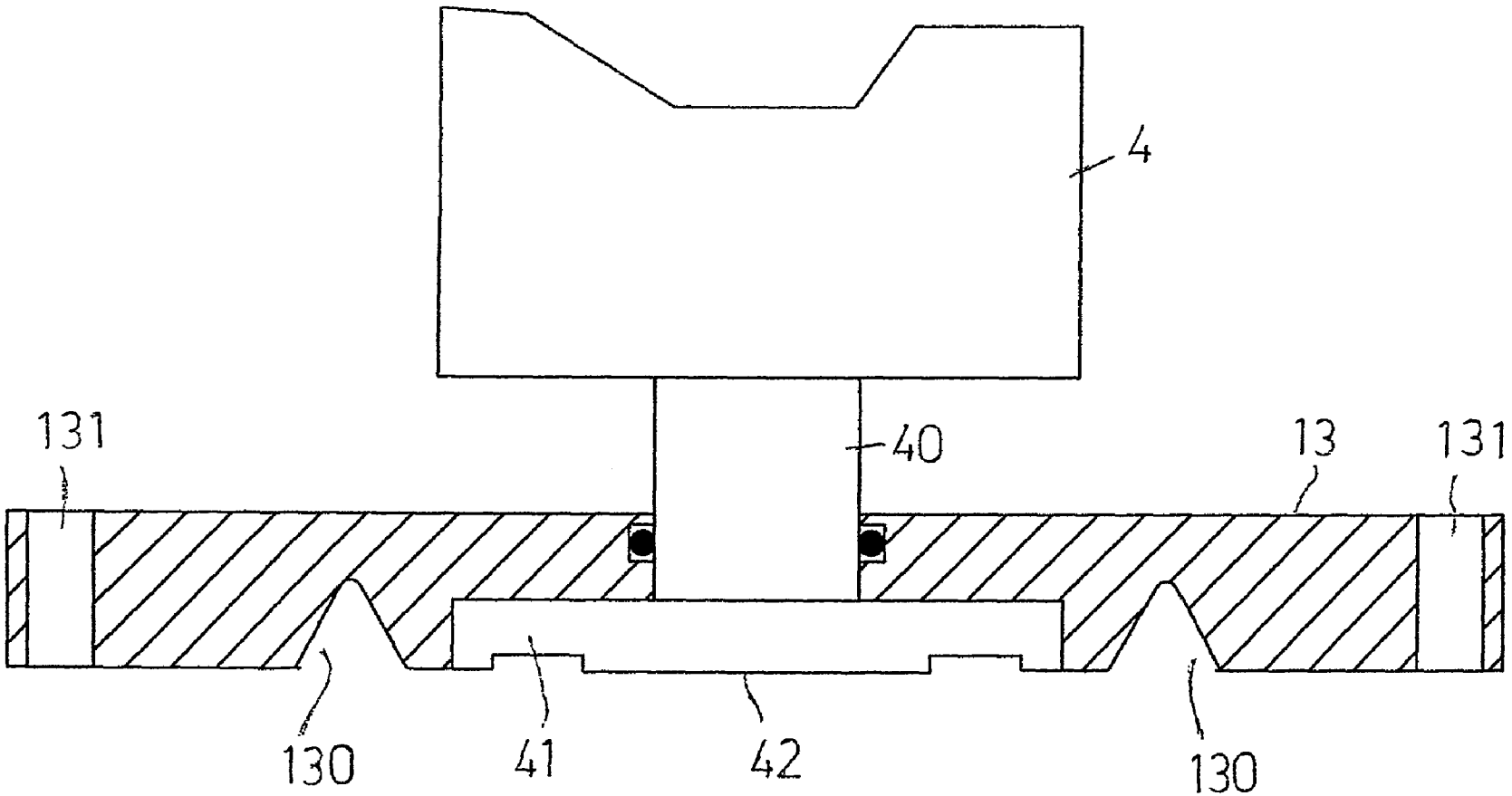
FIG. 11 is an enlarged detail of the device shown in FIG. 4.
Figure 12:
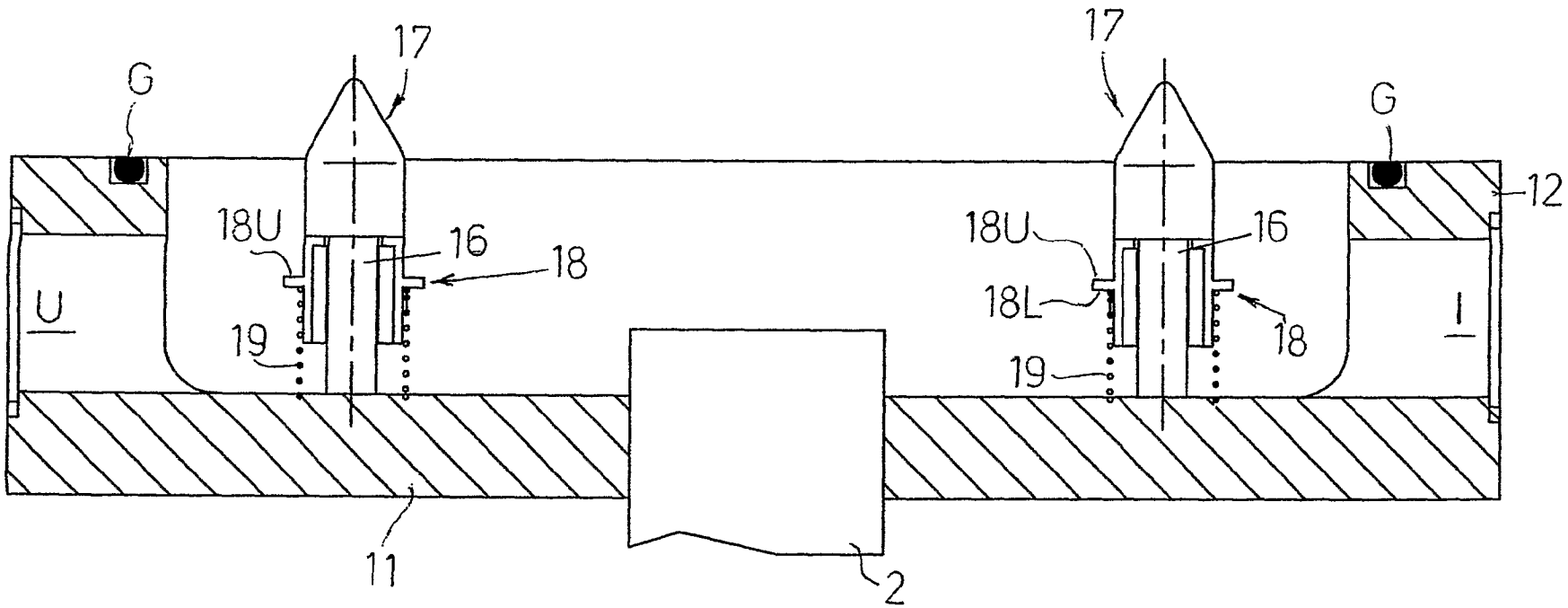
FIG. 12 is a further enlarged detail of the device shown in FIG. 4.
Figure 13:
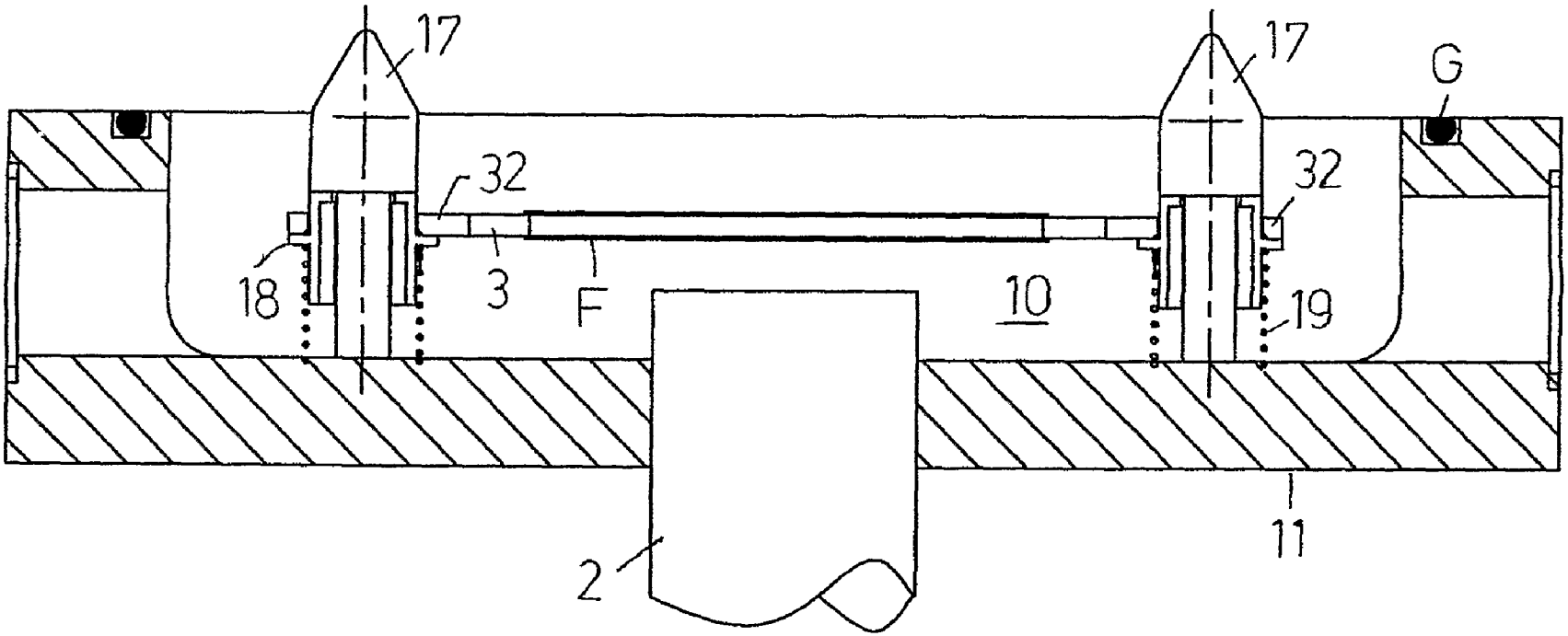
FIG. 13 shows an enlarged detail of FIG. 9.
Figure 14:
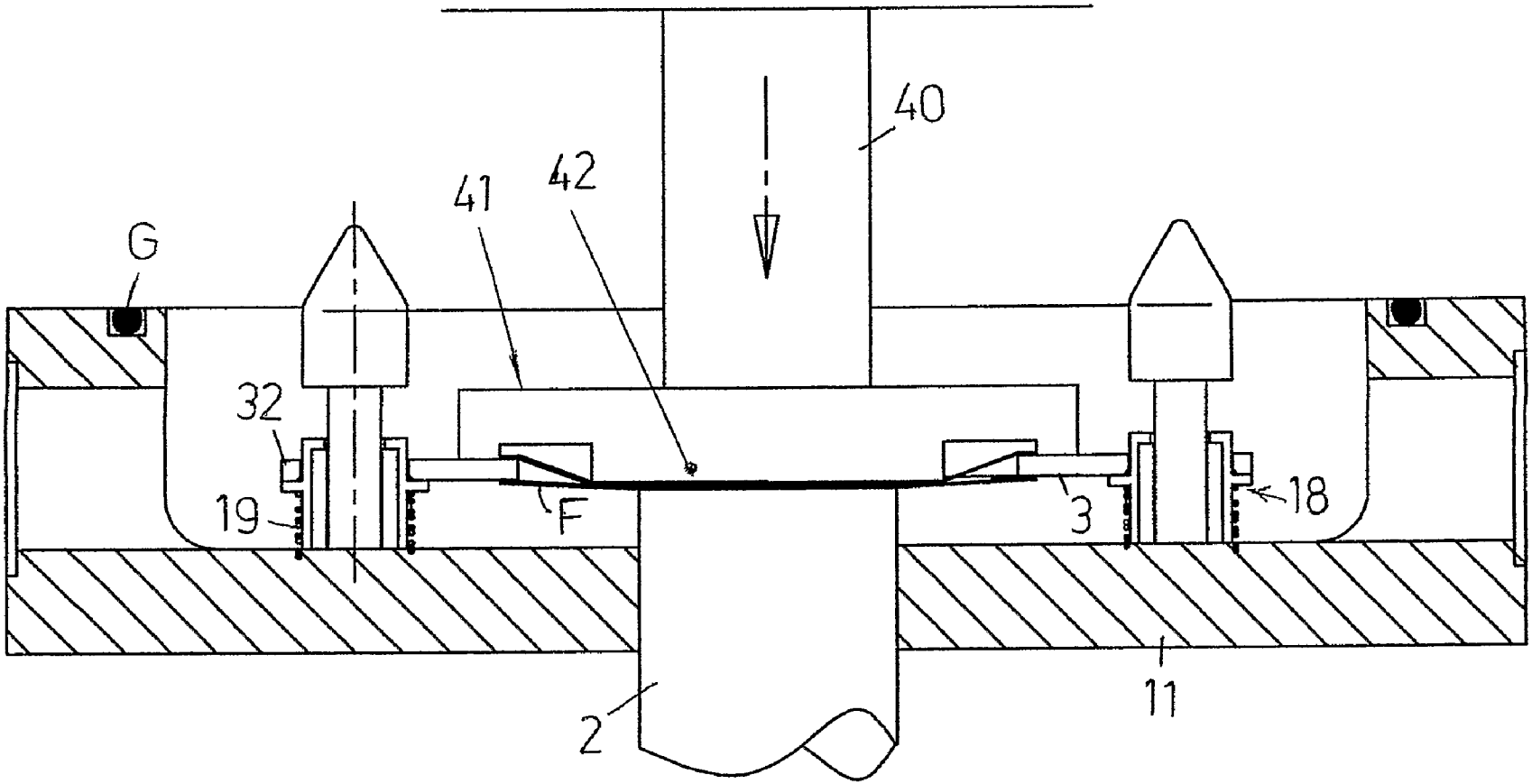
FIG. 14 shows an enlarged detail of FIG. 10, in this figure the upper base (13) being not shown to better illustrate the arrangement of the elements inside chamber (10)
Figure 15:
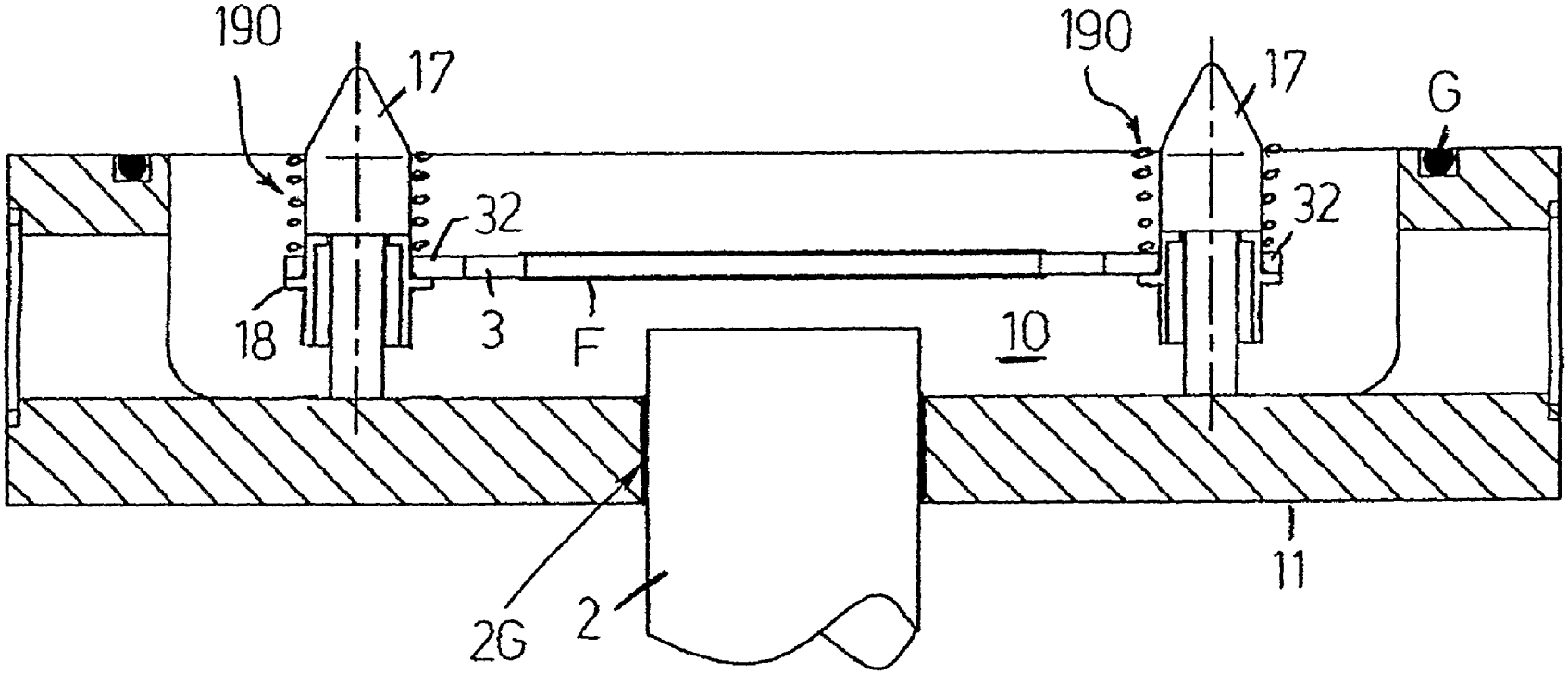
FIGS. 15-18 are similar to FIGS. 11-14 but they refer to a further possible embodiment of a device according to the present invention.
Figure 16:
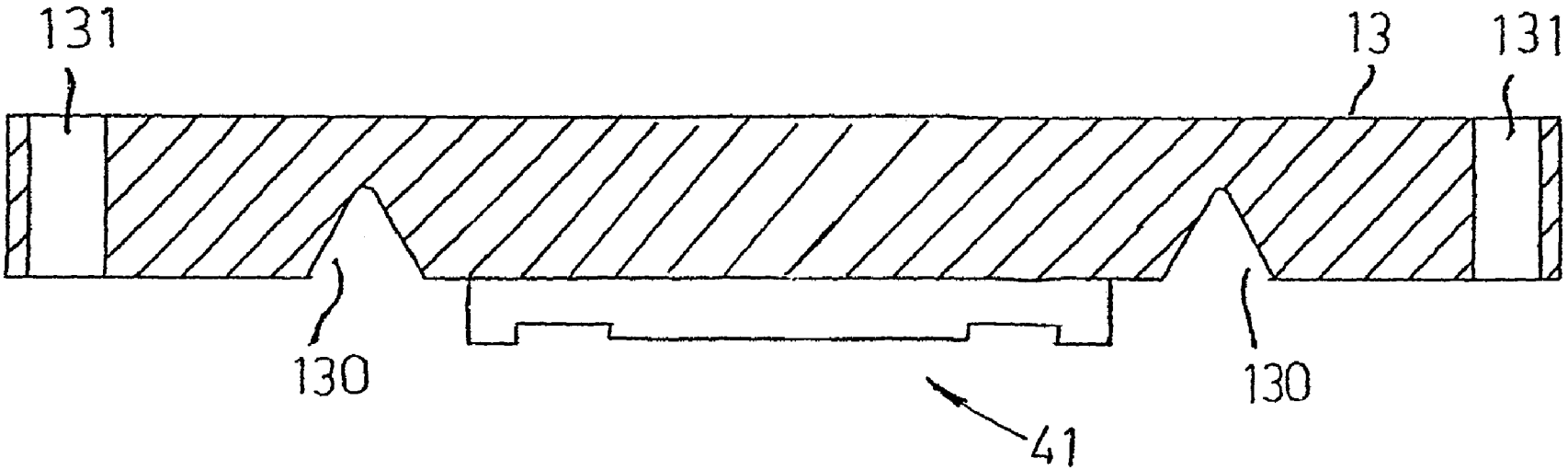
Figure 17:
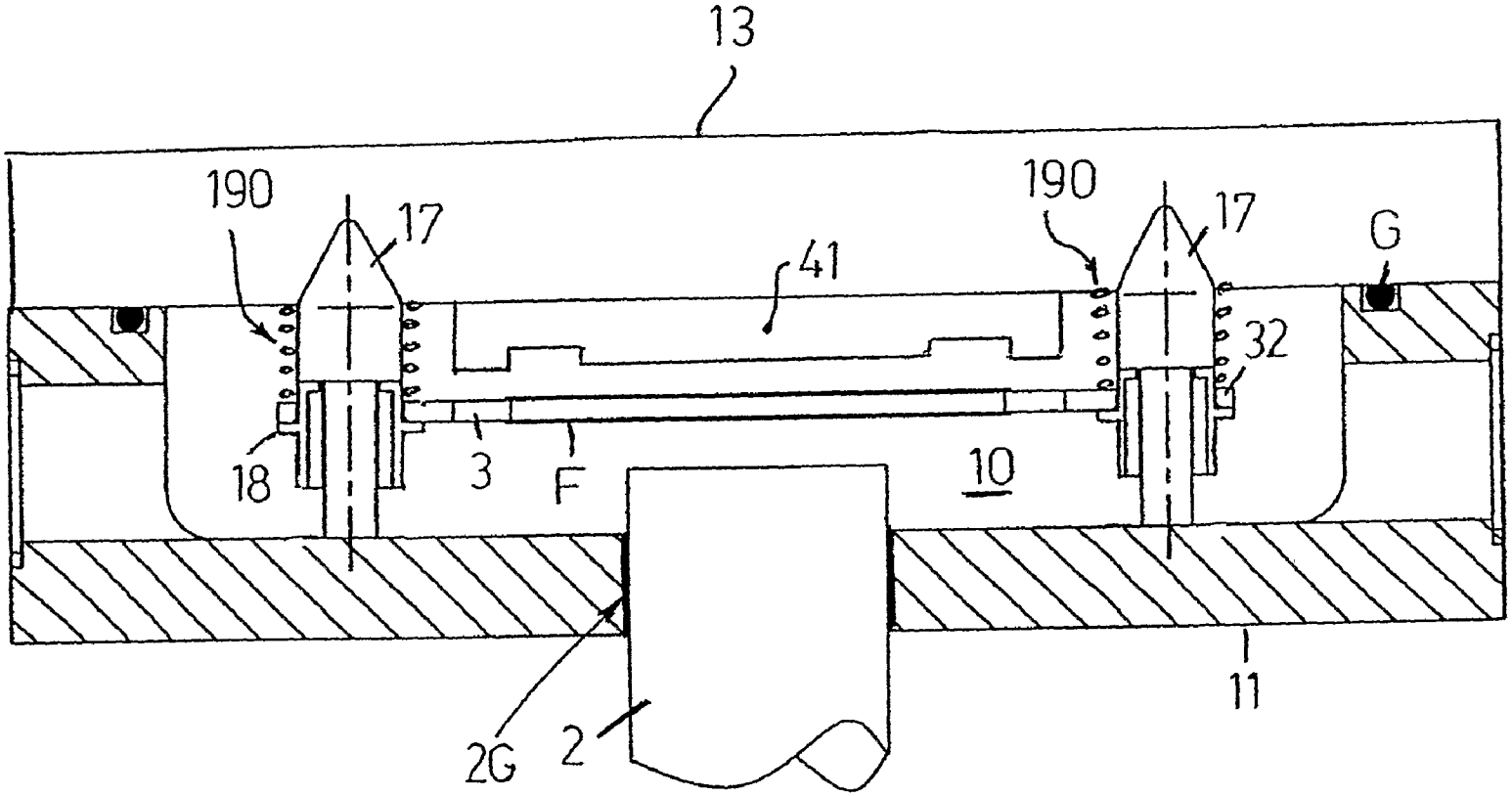
Figure 18:
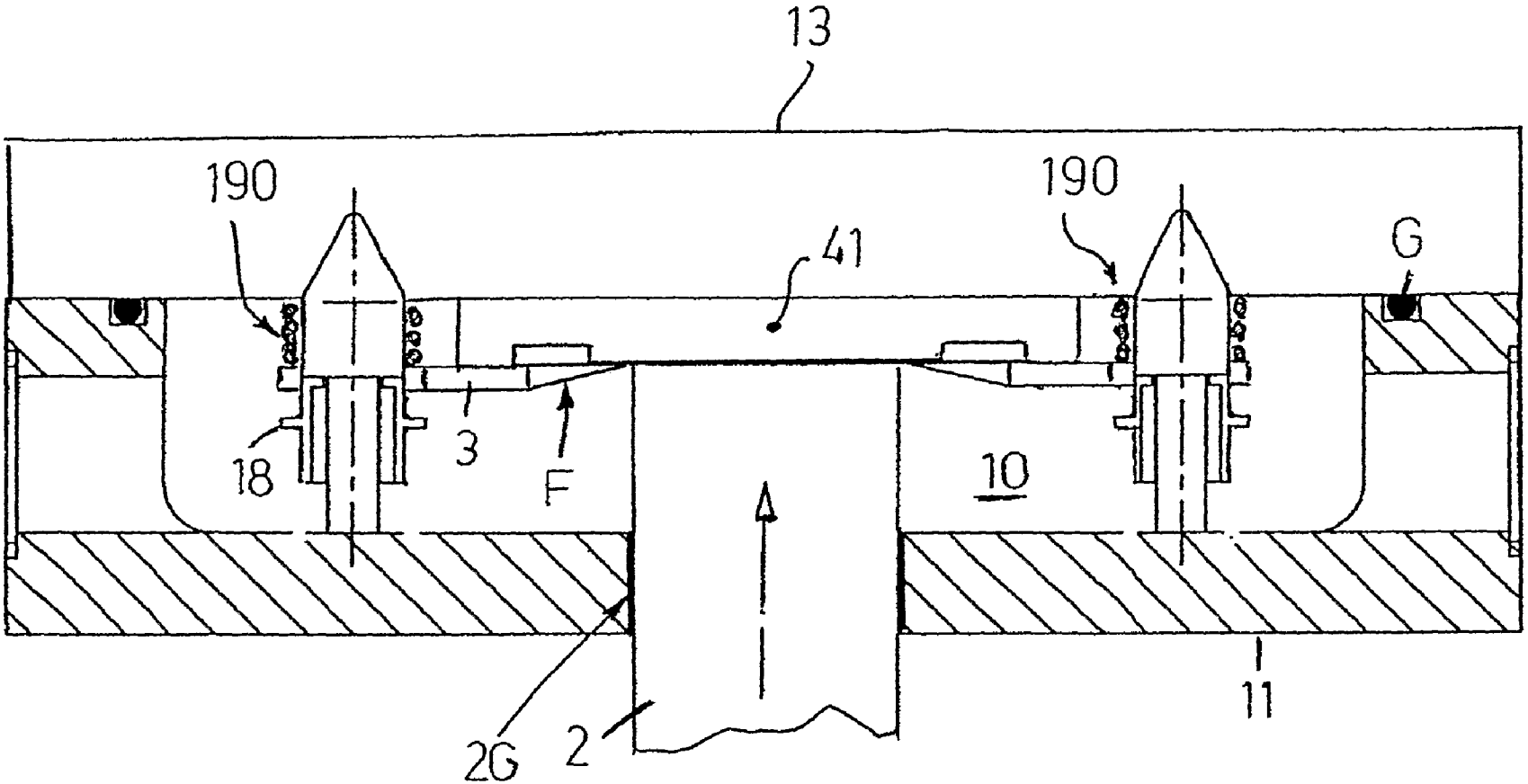

A specimen or sample of the material submitted to dyeing in the tank or machine is positioned on plate (3). For example, as shown in FIG. 3, it is possible to use a given amount of yarn (of the same material as that present in tank or machine "T") wound on plate (3) so as to cover the window (30), being intended that the textile material present in the dyeing tank or machine (T) can be in any other form, i.e. not only in the yarn form. Then, the upper base (13) of the device being detached from lower base (11), plate (3) is positioned on the elastic support constituted by bushings (18) fitted on columns (16), the extensions (32) of plate (3) resting on upper side (18U) of said annular projections as shown in FIGS. 7, 8 and 13; in this way, plate (3) is positioned on an elastic support and window (30) of plate (3) faces the probe (2) and is covered by thread (F), that is to say by the material the specimen is made of. Upper base (13) is subsequently fixed to lower base (11) as shown in FIG. 9. In this way, the chamber (10) is hermetically closed both superiorly and inferiorly and the bath drawn out of tank or machine (T) can flow inside it. The positioning upper base (13) on lower base (11) is facilitated by the presence of said tips (17) which act as guide elements as their shape corresponds to that of cavities (130) provided on the upper base. The dyeing bath flowing inside chamber (10) moves relative to the specimen of material (F) on plate (3) which is thus submitted to dyeing like the textile material present in the dyeing tank or dyeing machine (T). After closing the device, that is after fixing upper base (13) to lower base (11), the device can be operatively used: at given time intervals, actuator (4) is operated so as to obtain the lowering of pad (41) to bring the specimen of material (F) into contact with probe (2) as illustrated in FIG. 10 and in FIG. 14. As shown in detail in FIG. 14, the wet material (F) is brought into contact with the optical reading probe (2) that emits an optical signal to spectrophotometer or calorimeter (20) which processes it. The presence of projection (42) on the lower side of pad (41) allows the perfect pushing of the specimen material on probe (2) without tearing it. At the end of each reading, the stem of actuator (4) is retracted, so as to eliminate the thrust on plate (3) which consequently rises and returns back to the lifted starting position, as said plate rests on the elastic support constituted by bushings (18) and springs (19). In this way, the specimen returns to an ideal position for a correct and uniform dyeing. The optical reading is cyclically repeated as long as the material submitted to dyeing remains in tank or machine (T).

The processing of the luminous signal transmitted by probe (2) to spectrophotometer or calorimeter (20) takes place according to known algorithms which are not described in detail as the technician working in this field already know them. Said algorithms allow the absorption evaluation of the single colouring agents present in the material the specimen is made of (that is to say the material submitted to dyeing in tank or machine T) that is, they allow the evaluation of colouring agents depletion, even when a pH or temperature variation of the dyeing bath take place or a salinity variation occurs, and so on.

The reading, that is to say the spectroscopic analysis of the signal sent by probe (2) to spectrophotometer (20) directly concerns the dyed material. In other words, as the material of the specimen is brought directly into contact with probe (2) the typical errors made by devices by means of which the reading is carried out on the dyeing bath are avoided. In fact, during the reading step, the specimen material is pushed and then held on probe (2) by pad (41), so as to avoid any interferences of the dyeing bath on the readings themselves. The optical reading is carried out by device (1) by reflectance instead of by transmittance as provided by conventional systems.

A method according to the present invention comprises the following operative steps:

- providing a first optical reading chamber (10) into which a dyeing bath flows, said dyeing bath being drawn out of a dyeing tank or machine (T) carrying out a dyeing process on a given textile material;
- providing a sample or specimen (F) made of the same material of which said textile material is made and positioning said sample onto a support inside said first optical reading chamber (10), said sample being submitted to dyeing by the dyeing bath flowing inside the first optical reading chamber;
- cyclically approaching said support to an optical detector (2);
- by means of said optical detector (2) emitting a luminous signal on the specimen surface and transmitting the light reflected by the specimen surface to optical processing means; and
- moving said support with the specimen of material (F) away from said optical detector (2).

Advantageously, said specimen (F) is elastically applied onto a mobile support from and towards said optical reading probe.

Moreover, said approaching of the specimen to the optical reading probe is advantageously carried out by exerting a thrust on the specimen and, when the specimen is moved away from the optical reading probe, said thrust is removed.

In any case, the present operating method provides for a direct optical reading, i.e. an optical reading executed on the sample or specimen immersed in the dyeing bath. In practice, the reflectance optical reading implies the measurement of the amount of light reflected by the surface of the specimen immersed in the dyeing bath in relation to the amount of light incident upon its surface.

Thanks to the present invention, it is possible to carry out a correct and reliable depletion test of the single colours (red, yellow, blue) in the dyeing bath, whatever the chemical class or nature of the colouring agents employed, even in case of very low or very high concentrations, considering the specific nature of the material submitted to dyeing, that is to say considering the real absorption and o the consequent real depletion of the single colours through the textile material.

FIGS. 15-18 relate to an alternative embodiment of the reflectance reading device (1). Here, said paid (41) is fixed to the lower side of upper base (13) and the bottom of lower base (11) features a central opening within which the probe (2) is positioned. A tubular gasket (2G) is positioned between the probe (2) and said opening. The probe (2) can be lifted and lowered by means of a respective actuator (not shown in the drawings). Said actuator for lifting and lowering the probe (2) can be of any conventional type. According to this alternative embodiment of the reflectance reading device (1), the probe (2) moves towards the sample (F). In practice, the plate (3) is positioned on bushes (18) and coil springs (190) are fitted on the columns (16) so as their lower basis rest on the upper side (18U) of annular projections (18). Then, the upper base (13) is connected to the lower base (11) as described with reference to first embodiment. Cyclically, the probe (2) is lifted. Lifting of probe (2) causes support (3) to move towards the upper base (13) and the thus exerted thrust overcome the resistance of springs (190). At the end of the probe (2) lifting, the sample (F) is pressed between the same probe and the pad (41) and the optical reading is executed. According to this embodiment, the probe (2) is moved towards the sample (F) instead of moving the sample (F) towards the probe (2).

The drawings only show practical embodiments of the invention, which can vary in forms and arrangements without however departing from the scope of the concept on which the invention is based. Any reference numerals in the appended claims are provided purely to facilitate reading thereof in the light of the description and accompanying drawings, without limiting the scope of protection in any way.

The invention claimed is:

1. Device for carrying out optical readings on textile materials submitted to dyeing comprising optical reading means associated with corresponding optical processing means, characterised in that it comprises a body (1) inside which it is provided a chamber (10) featuring an input (I) and output (U) section and is crossed by a dyeing bath drawn out of a dyeing tank or machine (T) in which a textile material is submitted to dyeing, inside said chamber (10) being disposed an optical detector or probe (2) and a seat being provided for the positioning of a specimen or sample (F) of the textile material submitted to dyeing in correspondence of the probe (2), said seat featuring positioning means for a support (3) onto which said specimen (F) is applied, so that the specimen is immersed in the dyeing bath flowing inside chamber (10), said support (3) being movably positioned on said positioning means; and said support (3) is movable towards said probe (2) or, vice versa, said probe (2) is movable towards said support (3).

2. Device according to claim 1 characterised in that said body (1) comprises a lower fixed base (11) to which said optical detector or probe (2) is associated and a movable base (13) with which an actuator (4) is associated, said actuator (4) acting on said support (3) to move it towards the optical detector or probe (2).

3. Device according to claim 1 characterised in that said support (3) for the sample or specimen (F) of the textile material submitted to dyeing comprises a plate featuring a central opening (30).

4. Device according to claim 1 characterised in that said positioning means for the support (3) of the sample or specimen (F) of the material submitted to dyeing are elastic positioning means.

5. Device according to claim 1 characterised in that said positioning means for said support (3) of the sample or specimen (F) of the material submitted to dyeing comprise a plurality of bushings (18) which are inserted on fixed columns (16), each of said columns (16) emerging perpendicularly from the inside bottom of a fixed base (11) of body (1), in correspondence of which fixed base said detector or probe (2) is positioned and acting, being each bushing (18) provided with an annular projection which features an upper side (18U) and a lower side (18L), being a spring (19) positioned between lower side (18L) of each bushing (18) and the bottom of base (11).

6. Device according to claim 5 characterised in that each of said columns (16) is provided with a corresponding tip (17).

7. Device according to claim 3 characterised in that said plate (3) features a plurality of holes (31) through which it is mounted on said positioning means.

8. Device according to claim 2 characterised in that said actuator (4) is provided with a pad (41) intended to push said specimen (F) towards said detector or probe (2).

9. Device according to claim 8 characterised in that said pad (41) features a central projection (42).

10. Apparatus according to claim 1 characterised in that said positioning means for the support (3) of the sample or specimen (F) of the material submitted to dyeing comprise a plurality of bushings (18) inserted on fixed columns (16), each of said columns (16) emerging perpendicularly from the internal bottom of a fixed base (11) of said body, in correspondence of which fixed base said detector or probe (2) is positioned and acting, being each of said bushings (18) provided with an annular projection featuring an upper side (18U) and a lower side (18L), being a spring (19) positioned between lower side (18L) of each of said bushings and the bottom of base (11), and further characterised in that said support (3) for specimen (F) of the textile material submitted to dyeing comprises a plate featuring a central opening (30), featuring said plate (3) a plurality of holes (31) through which it is mounted on said bushings (18) so as to rest on the corresponding upper sides (18U).

11. Apparatus according to claim 1 characterised in that said positioning means for the support (3) of the sample or specimen (F) of the material submitted to comprise a plurality of bushings (18) inserted on fixed columns (16), each of said columns (16) emerging perpendicularly from the internal bottom of a fixed base (11) of said body, in correspondence of which fixed base said detector or probe (2) is positioned and acting, being each of said bushings (18) provided with an annular projection featuring an upper side (18U) and a lower side (18L), being a spring (19) positioned between lower side (18L) of each of said bushings and the bottom of base (11), and further characterised in that each of said columns (16) is provided with a corresponding tip (17) and in that a mobile base (13) of said body (1) is provided with cavities (130) corresponding to said tips (17).

12. Apparatus according to claim 1 characterised in that said body (1) features two pipe unions (14, 15) by means of which it can be introduced into a circuit for drawing the dyeing bath out of the dyeing tank or machine (T).

13. Method for carrying out optical readings on textile materials submitted to dyeing characterised in that it comprises the following operating steps:

providing an optical reading chamber (10) into which a dyeing bath flows, said dyeing bath being drawn out of a dyeing tank or machine (T) carrying out a dyeing process on a given textile material;

providing a sample or specimen (F) made of the same material of which said textile material is made and positioning said sample onto a corresponding support (3) inside said first optical reading chamber (10), said sample being submitted to dyeing by the dyeing bath flowing inside the first optical reading chamber;

cyclically approaching said support (3) to an optical detector or probe (2) or, vice versa, approaching the optical detector or probe (2) to the support (3);

by means of said optical detector (2) emitting a luminous signal on the specimen surface and transmitting the light reflected by the specimen surface to optical processing means; and moving said support with the specimen of material (F) away from said optical detector (2) or, vice versa, moving said optical detector (2) away from said support with the specimen of material (F).

14. Method according to claim 13 characterised in that said specimen (F) is applied on a support (3) which can be elastically moved from and towards said optical reading probe.

15. Method according to claim 13 characterised in that said approaching of the specimen to the optical reading probe is carried out by exerting a thrust on the specimen.

16. Method for carrying out optical readings on textile materials submitted to dyeing characterised in that it comprises the following operating steps:

providing an optical reading chamber (10) into which a dyeing bath flows, said dyeing bath being drawn out of a dyeing tank or machine (T) carrying out a dyeing process on a given textile material;

providing a sample or specimen (F) made of the same textile submitted to dyeing in said dyeing tank or machine (T);

cyclically, inside said optical reading chamber, providing a reflectance optical reading on the sample specimen immersed in the dyeing bath.

* * * * *